United States Patent [19]

Sheffer

[11] Patent Number: 4,651,651

[45] Date of Patent: Mar. 24, 1987

[54] SHELVING UNITS

[75] Inventor: Phil B. Sheffer, New Oxford, Pa.

[73] Assignee: Merchandising Innovations, Inc., Hanover, Pa.

[21] Appl. No.: 796,968

[22] Filed: Nov. 12, 1985

[51] Int. Cl.[4] ..... A47B 3/00

[52] U.S. Cl. ..... 108/111; 312/263

[58] Field of Search ..... 108/111, 109, 110, 112; 312/330, 119, 122, 234.5, 263; 211/135; 52/36, 795, 796; 248/916, 174

[56] References Cited

U.S. PATENT DOCUMENTS

| | | | |
|---|---|---|---|
| 113,871 | 4/1871 | Gibbons | 308/3.6 |
| 3,031,044 | 4/1962 | Stitt et al. | 52/795 |
| 3,491,896 | 1/1970 | Cary | 108/111 |
| 3,580,192 | 5/1971 | Davidson | 52/36 X |
| 3,851,938 | 12/1974 | McCowan et al. | 108/107 X |
| 4,021,089 | 5/1977 | Bush | 312/263 X |
| 4,028,855 | 6/1977 | Prewer | 52/36 X |
| 4,047,777 | 9/1977 | Pfeifer et al. | 312/263 |
| 4,109,961 | 8/1978 | Opsvik | 108/110 X |
| 4,151,803 | 5/1979 | Ferrera et al. | 108/111 X |
| 4,236,460 | 12/1980 | Poupko | 108/111 X |
| 4,294,055 | 10/1981 | Andresen | 52/795 |

FOREIGN PATENT DOCUMENTS

| | | | |
|---|---|---|---|
| 6861103 | 3/1965 | Italy | 108/111 |

*Primary Examiner*—Peter A. Aschenbrenner
*Assistant Examiner*—José V. Chen
*Attorney, Agent, or Firm*—Daniel J. O'Connor

[57] ABSTRACT

A shelving unit construction which is useful for books or other items.

The preferred material of the invention comprises corrugated fiberboard layers which are factory preglued together. The various layers have factory cuts preformed therein in a design which results in a unique interlocking combination for easy assembly by the purchaser.

The design allows the component parts to be shipped in a flat or knockdown position to save shipping volume and hence reduce shipping costs.

A sturdy and attractive shelf unit results which may be assembled utilizing a minimal number of fasteners.

1 Claim, 5 Drawing Figures

10
11
12
13
14
15
16
21
22
23
24
25
26
31
32
33
34
35

40

50
55
55
54
54
51
52
53

SHELVING UNITS

Papers relating to the present invention were previously filed under the Disclosure Document Program of the U.S. Patent Office.

BACKGROUND OF THE INVENTION

The high cost of attractive shelving units for home and industrial use is well-appreciated in the furniture arts.

Part of the high cost of such shelving units resides in the materials utilized in fabricating same, such being normally woods, metals, plastics, etc. Further, the weight of such materials as woods and metals increases shipping costs thus raising the purchase price of the overall units.

Another reason for the high cost of such shelving units is that the more attractive units are normally shipped in a completely assembled form, thus requiring excessive shipping space, hence increasing overall costs to the purchaser.

Such fully assembled units must also be packaged and handled more carefully in order to avoid damage in transit.

Although the demand for attractive and durable shelving units is great, the high cost of such units has effectively hampered market sales.

It has also been realized in the art that currently available shelving units which are shipped in a disassembled condition are often of inferior quality and further require a large number of fasteners to accomplish assembly, thus tending to discourage sales of such units.

PRIOR ART PATENTS

The following United States Patents illustrate the current state of the art regards shelving units which are of the knockdown variety intended for assembly by the ultimate user: U.S. Pat. No. 4,098,197 issued to Jorgensen; U.S. Pat. No. 3,100,460 issued to McElroy; U.S. Pat. No. 4,151,803 issued to Ferrera.

The Jorgensen and McElroy patents shown designs intended to use metal components formed so as to be very costly to manufacture, thus raising the cost to the user. Further, such patents utilize numerous sharp and dangerous edges and complex assembly procedures which would leave a manufactuere thereof vulnerable to products liability lawsuits.

The patent to Ferrera shows a knockdown shelf unit formed principally of corrugated board materials but which requires rope elements in the main areas of support. As compared to the present invention, assembly of the Ferrera device is relatively complex and requires plural fasteners of different types to complete construction of the shelving unit.

OBJECTS OF THE INVENTION

Accordingly, it is an object of the present invention to provide shelving units which are made of a light weight material to reduce shipping costs but which at the same time are durable and attractive in appearance.

It is a further object of the present invention to provide shelving units which may be shipped in a flat or knockdown position to reduce shipping space requirements and thus lower unit costs to the ultimate consumer.

It is a further object to provide a shelving unit construction which may be economically manufactured yet results in a highly stable and attractive unit upon assembly.

It is also an object to provide shelving units which may be easily and quickly assembled by the purchaser and, significantly, without the need for complex fastening procedures.

It is a further object to provide shelving units with reduced risk of injury to the consumer.

Further objects and advantages of the present invention will become apparent as the following description proceeds, and the features of novelty characterizing the invention will be pointed out with particularity in the claims annexed to and forming a part of this specification.

BRIEF SUMMARY OF THE INVENTION

The invention utilizes corrugated fiberboard layers which are stacked to form durable vertical side walls and shelf components.

Corrugated fiberboard is also used to form a rear panel for the units.

Due to the unique design of the various layers of the side walls, shelves and back panel, a shelving kit is produced which, while very easy to assemble, results in a highly durable end product shelving unit which is attractive in appearance.

FULL DESCRIPTION OF THE PREFERRED EMBODIMENT

Figure 1:
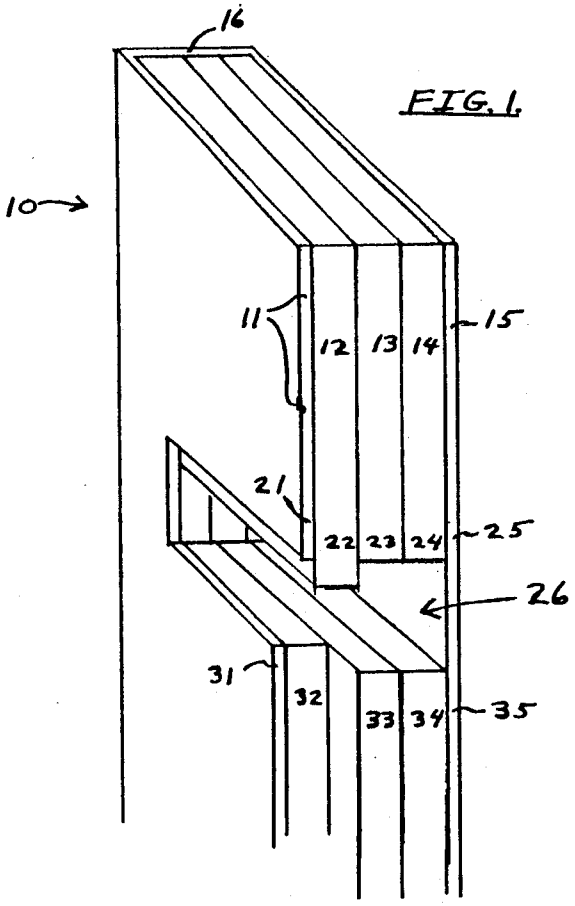
FIGS. 1 and 2 show vertical uprights in accord with the present invention.

Referring now to the drawings in detail, there is shown in FIG. 1 the left upright 10 of the shelving unit.

As indicated, the upright section 10 has three core sections 12, 13 and 14 which comprise corrugated double-wall fiberboard. An outer one-piece wrap indicated by numerals 11, 16 and 15 forms the fourth die cut piece of the upright.

The portions of the respective sections which lie in the region of the shelf receiving slots 26 are indicated by numerals 21 through 25 and 31 through 35 respectively. As indicated at 22, section 12 extends into the slotted area 26 further than the adjacent sections 21 and 23. The function of such extension 22 is to cooperate with a slot formed in the shelves as will be further explained.

It should also be noted from FIG. 1 that portions 31 and 32 have been pre-cut so as not to extend outwardly as far as portions 33, 34 and 35. Such recessed areas 31 and 32 are designed to run the entire length between the top and bottom slot apertures of a given upright 10. The function of such recessed areas is to receive a back panel which will be further explained.

Figure 2:
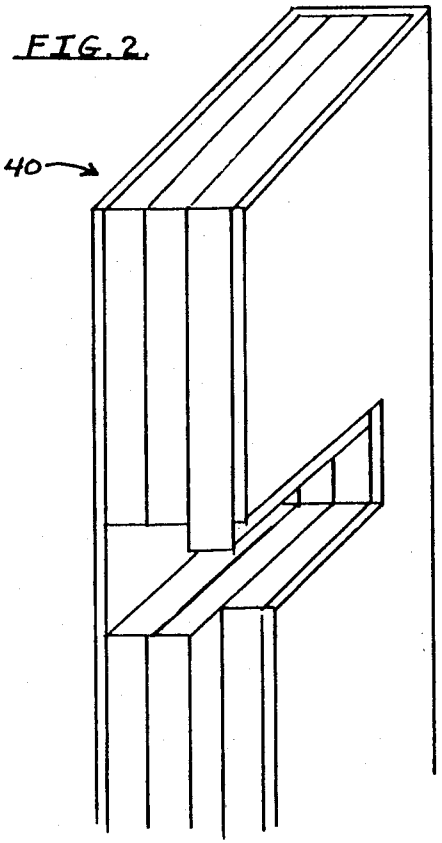

FIG. 2 represents the right upright panel 40 and it can be seen that it is the mirror image of the construction shown in FIG. 1.

Figure 3:
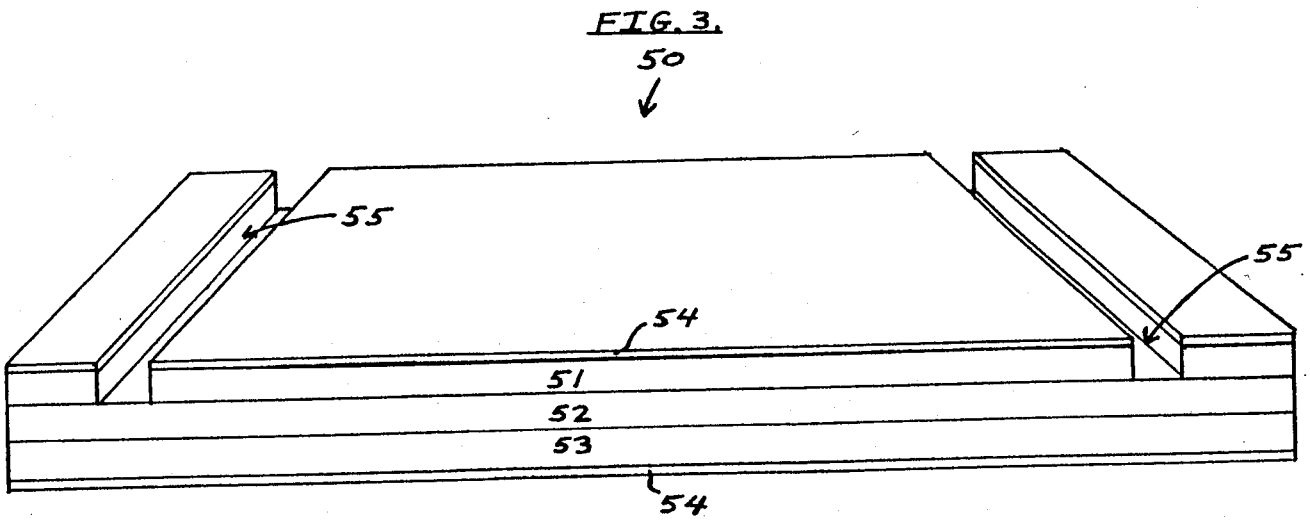
FIG. 3 shows a shelving unit in the layered corrugated fiberboard configuration of the present invention.

FIG. 3 illustrates the shelf construction. It is contemplated that each shelf 50 will comprise three core layers 51, 52 and 53 with each layer being corrugated double wall fiberboard. An outer wrap layer of single wall corrugated material is indicated at numeral 54.

The layers 51, 52, 53 and 54 are glued together before shipping and grooves 55 are cut in appropriate locations and depths for purposes to be further explained.

Figure 5:
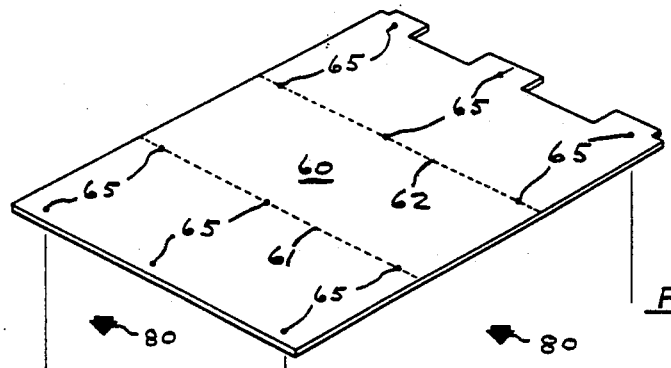
FIG. 5 shows the rear panel shape.
Figure 4:
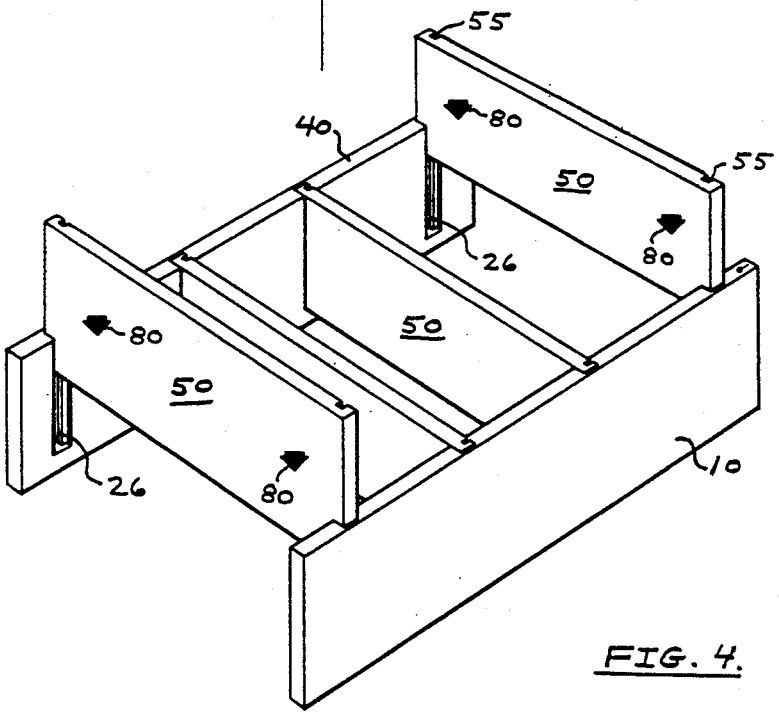
FIG. 4 illustrates assembly of the shelves into the upright panels.

Unit assembly is indicated by arrows 80 in FIGS. 4 and 5.

As shown in FIG. 4, shelves 50 are slid into slots 26 formed in the upright sections 10 and 40. This is done in such a way that grooves 55 formed in the shelves 50 ride along the extended sections 22 formed in one layer of the uprights. Such feature tends to hold the shelves firmly in place and adds rigidity to the overall structure.

As indicated by FIG. 5, a rear panel is then positioned on the unit so that it rests on the recessed portions 31 and 32 previously described in FIG. 1. The rear panel is then simply attached to the shelves 50 by means of screws at 65. Score lines 61 and 62 on the rear panel indicate that it may be folded for shipment if desired. The rear panel comprises a die cut piece of double wall material.

Since rear panel 60 rests in the recessed areas 31 and 32, it gives stability to the overall shelf unit, i.e. it prevents side-to-side swaying motion of the entire unit.

In practice, decorative outer layers are applied before shipping to give the unit a highly attractive appearance.

The end result is a thick-walled, sturdy and attractive unit which can be easily moved if desired.

Importantly, because of the relatively inexpensive corrugated fiberboard layers used, the units can be very competitively sold as compared to other shelving units currently on the market.

It is also again emphasized that because the unit components may be shipped in a flat or knockdown position, shipping costs are significantly reduced.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A combination shelving unit having vertical uprights and shelf assemblies wherein, said vertical uprights (10) comprise plural core sections (12, 13, 14), said core sections being factory pre-fastened together, each of said vertical uprights (10) having at least one shelf receiving slot (26) formed therein, means whereby at least one of said core sections (12) has an extension (22) formed thereon which extends into said shelf receiving slot (26), and wherein each of said shelf assemblies (50) comprises plural core sections (51, 52, 53) being factory pre-fastened together, at least one of said core sections having grooves (55) factory pre-cut therein, means whereby said shelf assemblies (50) may be slid into said shelf receiving slot (26) such that said extension (22) formed on said core section (12) of a vertical upright (10) is fitted into a groove (55) formed in at least one of said core sections (51, 52, 53) which form said shelf assemblies (50), wherein the core sections (12, 13, 14) of the vertical uprights (10) comprise fiberboard material and wherein the core sections (51, 52, 53) of the shelf assemblies (50) comprise fiberboard, wherein the vertical uprights (10) each have outer wrapping layers (11, 15) comprised of single wall fiberboard and wherein each of the shelving units (50) have outer wrapping layers (54) comprised of single wall fiberboard, said combination shelving unit including a rear panel element (60), including means (65) for attaching said rear panel (60) to said combination shelving unit whereby means are provided by said rear panel (60) for preventing swaying motion of the entire assembly thereby adding stability to the unit, wherein the core sections of said vertical uprights and the core sections of said shelf assemblies are prefastened together by means of gluing.

* * * * *